US009170007B2

(12) United States Patent
Erion

(10) Patent No.: US 9,170,007 B2
(45) Date of Patent: Oct. 27, 2015

(54) LED LIGHTING DEVICE AND SYSTEM

(76) Inventor: Jeffrey Allen Erion, Plymouth, MI (US)

( * ) Notice: Subject to any disclaimer, the term of this patent is extended or adjusted under 35 U.S.C. 154(b) by 358 days.

(21) Appl. No.: 12/906,499

(22) Filed: Oct. 18, 2010

(65) Prior Publication Data

US 2011/0141724 A1 Jun. 16, 2011

Related U.S. Application Data

(60) Provisional application No. 61/252,931, filed on Oct. 19, 2009.

(51) Int. Cl.

| | |
|---|---|
| ***F21V 29/00*** | (2015.01) |
| ***F21V 9/00*** | (2015.01) |
| ***F21V 23/00*** | (2015.01) |
| ***F21V 29/74*** | (2015.01) |
| *F21V 5/04* | (2006.01) |
| *F21V 7/00* | (2006.01) |
| *F21Y 101/02* | (2006.01) |
| *F21Y 103/00* | (2006.01) |

(52) U.S. Cl.

CPC ..... *F21V 23/009* (2013.01); *F21V 29/74* (2015.01); *F21V 5/043* (2013.01); *F21V 7/0091* (2013.01); *F21Y 2101/02* (2013.01); *F21Y 2103/003* (2013.01)

(58) Field of Classification Search

CPC ..... F21V 5/04; F21V 5/043; F21V 29/002; F21V 29/004; F21V 29/20; F21V 29/22; F21V 29/2206; F21V 29/2212; F21S 4/003; F21S 4/043; F21K 9/00; F21K 9/30; F21Y 2101/02; F21Y 2101/025; F21Y 2103/00; F21Y 2103/003

USPC ..... 362/218–223, 217.3, 294, 345, 373

See application file for complete search history.

(56) References Cited

U.S. PATENT DOCUMENTS

| | | | | |
|---|---|---|---|---|
| 6,481,130 | B1 | 11/2002 | Wu | |
| 6,634,779 | B2 | 10/2003 | Reed | |
| 6,641,284 | B2 | 11/2003 | Stopa et al. | |
| 6,680,628 | B2 | 1/2004 | Brunet et al. | |
| 6,776,504 | B2 | 8/2004 | Sloan et al. | |
| 6,880,952 | B2 | 4/2005 | Kiraly et al. | |
| 7,008,079 | B2 | 3/2006 | Smith | |
| 7,114,830 | B2 | 10/2006 | Robertson et al. | |
| 7,159,997 | B2 | 1/2007 | Reo et al. | |
| 7,244,058 | B2 | 7/2007 | DiPenti et al. | |
| 8,093,823 | B1 * | 1/2012 | Ivey et al. | 315/246 |
| 2005/0201098 | A1 * | 9/2005 | DiPenti et al. | 362/294 |
| 2008/0037239 | A1 * | 2/2008 | Thomas et al. | 362/92 |
| 2009/0168419 | A1 * | 7/2009 | Daimon | 362/235 |
| 2009/0190350 | A1 * | 7/2009 | Tseng et al. | 362/249.01 |
| 2009/0219713 | A1 * | 9/2009 | Siemiet et al. | 362/218 |

* cited by examiner

*Primary Examiner* — Thomas M Sember

(74) *Attorney, Agent, or Firm* — The Bilicki Law Firm, PC

(57) ABSTRACT

A lighting device includes a support structure formed from a thermally conductive material such as aluminum. The support structure or extrusion has a channel for receiving and retaining a circuit board with a plurality of light emitting diodes (LEDs) disposed thereon. One or more fins adapted for dissipating heat produced by the LEDs may be disposed on the support structure. The support structure may also include one or more retaining members for retaining one or more optical elements in relation to the LEDs and a support tray for holding a power supply.

11 Claims, 3 Drawing Sheets

LED LIGHTING DEVICE AND SYSTEM

CLAIM OF PRIORITY

This application claims priority to U.S. Provisional Patent Application, Ser. No. 61/252,931, filed Oct. 19, 2009.

TECHNICAL FIELD

The disclosure relates to, among other things, an LED lighting device and system, including LED lighting systems that can be cost effective, modular, and very flexible from a design standpoint.

BACKGROUND

LED lighting systems have been developed for general illumination applications, and LED conversions have been introduced to replace existing types of illumination. However, such systems have principally been focused on the replacement of incandescent or high intensity discharge (HID) sources with white LEDs.

Current industry practices commonly employ fluorescent tubes as a light source for illumination. Fluorescent bulbs are generally available in various standard lengths, sizes, power output, and color temperature. The familiar bulbs typically include standard pin connectors provided at each end that provide for the attachment and replacement of a tube without the need for tooling. Such bulbs typically have a finite life based on hours of use. They also house consumable products, which can lead to a loss of light output over time. Moreover, many conventional bulbs contain mercury as a means for creating a broadband color spectra. Such tubes are also commonly made of glass—a material that is not tolerant to impact.

Solid state replacements for various types of diffuse fluorescent sources typically requires the use of many LEDs in a line and specialized optics to generate the desired beam pattern. Most lighting system will include a light source, a lens, a power source, and some type of housing to protect the assemblage of components. The uniqueness of a lighting system can be driven by the uniqueness in the specifically intended lighting task.

BRIEF DESCRIPTION OF THE DRAWINGS

Embodiments of the invention are disclosed in the included drawing figures and illustrations. It is understood that the illustrated embodiments are not intended to limit the scope of the invention to the specific embodiments disclosed. On the contrary, the invention is intended to cover alternatives, modifications and equivalents, which may be included within the spirit and scope of the invention.

DETAILED DESCRIPTION

Figure 1:
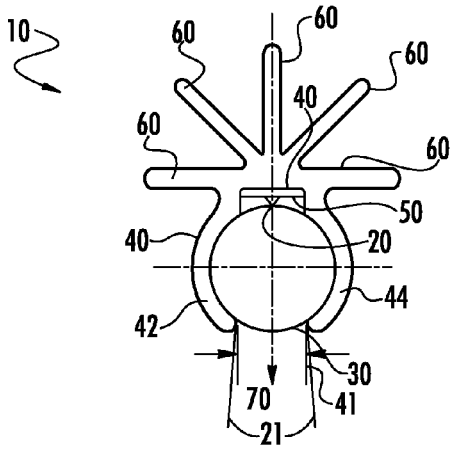
FIG. 1 illustrates a cross sectional view of an embodiment of a lighting device in accordance with teachings of the present disclosure.

As generally illustrated in FIG. 1, an embodiment of a device 10 includes, inter alia, an LED 20, an optical element 30, and a support structure 40. Embodiments of the device can also include a plurality of LEDs that may, if desired, be provided as part of, or in the form of, a printed circuit board (PCB) array or LED strip 50. In a simple embodiment, a linear string of white LEDs 20 may be mounted to a PCB. The optical element 30 may, without limitation, comprise a rod-shaped element having a round profile. Alternately the rod-shaped element may have a profile of another shape. Moreover, the optical element 30 may be clear, translucent, or colored. In embodiments, the optical element may be comprised of, without limitation, acrylic or glass.

The device may further include a plurality of protrusions or fins 60 that may be configured to provide a measure of thermal control, such as heat dissipation. By taking into account the power or heat associated with the LED 20 or LED strip 50, the protrusions or fins 60 can be configured to adequately handle the associated heat transfer. That is, the protrusion or fins 60 may be configured to assist in pulling heat from individual LEDs and to spread the heat laterally.

In embodiments, the device includes a plurality of LEDs 20. The LEDs may be white or colored. Further, some embodiments may employ a multi-color chip (e.g., on comprising RGB LEDs) that permits the device to effectively emit almost any desired color of light. In a particular embodiment, the centers of the LEDs 20 may be arranged in a line. The spacing and cumulative flux of the LEDs may be used to establish the total illumination supplied to an area or surface to be illuminated. It is noted that a channel or opening may be created in a portion of the support structure to permit the LEDs (which may be on a PCB) to be positioned sufficiently precisely relative to the optical element.

As generally illustrated in FIG. 1, the support structure 40 can be configured to hold or retain optical element 30. In the illustrated embodiment, light emitted by the LED may be transmitted through an opening 41 associated with the support structure 40 such as that generally illustrated by arrow 70 in FIG. 1. The dispersion (e.g., angle) of the light 21 emitted by the LED 20 and passing through the optical element 30 may be controlled by (a) the distance between the LED 20 and the optical element 30, and/or (b) modification of the opening 70 associated with the support structure. That is, the width of the pattern of light to be delivered to a surface or area may be determined by the shape of the optical element (e.g., transparent light rod), the area of optical element exposed at the light exit, and the position of the optical element in relation to the line of LEDs. A narrow opening in connection with an associated support structure or outer housing will create a narrow beam of light, a wider opening will allow a wider beam of light. The closer the optical element 30 is positioned to the LEDs 20, the wider the beam pattern; the further away, the narrower the beam pattern. Beyond a certain point, the beam becomes unfocused. Notably, for a number of embodiments, the LED 20 will be spaced very closely to the optical element 30, for example and without limitation, within about 0.010 to 0.020 inches.

Additionally, without limitation, in an embodiment the support structure 40 may include opposing support segments or portions, e.g., 42 and 44, that at least in part form a receiving area there between into which the optical element may be received. In an embodiment in which the optical element 30 comprises a rod, the opposing support segments may provide a receiving area into which the rod may, for instance, be slid into and retained.

Further, in embodiments, the support structure 40, which may include one or more protrusions or fins 60, may be formed integrally, e.g., via an extrusion process. This can permit the process of forming support structures to be fairly continuous and efficient from a production standpoint. In an embodiment, the support structure 40 may be, for example, comprised of aluminum. However, various other materials that are suitable for the intended environment and/or associated production techniques may be employed. It is noted that the disclosed structure, and the associated forms of processing—e.g., extrusion, supports both the array/strip 50 with the LEDs 20 and consequently provides and maintains a consistent relative positioning (which can be very important) between the LED and the optical element. The structure can further provide an integrated thermal control and/or protective structure for the device.

Figure 2:
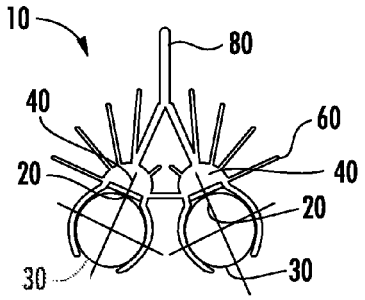
FIG. 2 illustrates a cross sectional view of another embodiment of a lighting device in accordance with teachings of the present disclosure, the device including multiple optical elements to provide separately directed lighting.

FIG. 2 generally illustrates a cross sectional view of another embodiment of a lighting device that includes multiple optical elements. As generally depicted, the multiple optical elements 30 may be provided in a single, integral support structure 40 that is configured to provide separately directed lighting. In an embodiment, as shown, the support structure 40 may include an extension 80, which can be commonly formed with the support structure 40, and may be configured to support the device 10.

Figure 3:
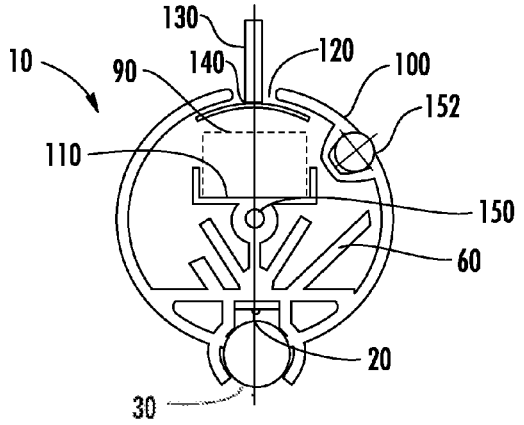
FIG. 3 illustrates a cross sectional view of yet another embodiment of a lighting device in accordance with teachings of the present disclosure, the device including an integral housing.

Yet another embodiment of a lighting device 10 is illustrated in FIG. 3. The illustrated device 10 includes a number of features in common with prior FIGS. 1 and 2, and additionally includes, inter alia, a power supply 90 (shown in broken lines) and a housing 100. While elements of a power supply or power source may be included remotely from the device, if desired and included, at least a portion of a power supply 90 can be provided in a given segment within the device—for example upon or within a power supply support tray 110. As generally illustrated, the housing 100 and/or a power supply support tray 110 may, if desired, be formed integrally with the support structure 40. If included the support tray 110 may also be configured to, in addition to any protrusions or fins 60, serve as an instrument for thermal management.

Also as generally illustrated, the device may optionally provide a connection opening 120, which may be in the form of an aperture or an "open" portion or segment of the housing 100 which may be used in connection with a means for connection or support. In the embodiment illustrated, the means for connection or support comprises a hanger 130 (e.g., a "T"-hanger) that can be inserted within the housing 100 and may be used to, at least in part, provide external support for the device 10. If desired, the hanger 130 may include threading or other connection features (not show) at or about portion 140. The device 10 may further additionally include an aperture or receiving opening 150. The aperture or receiving opening 150 may, if desired, also be formed integrally in connection with the support structure 40, and may be employed to, for example, secure an end cap (not shown). Moreover, as generally illustrated in FIG. 3, the device 10 may further include a smaller additional light 150. The additional light 150 may be colored and may, for example, remain on for safety when the other LEDs are inactive.

Figure 4:
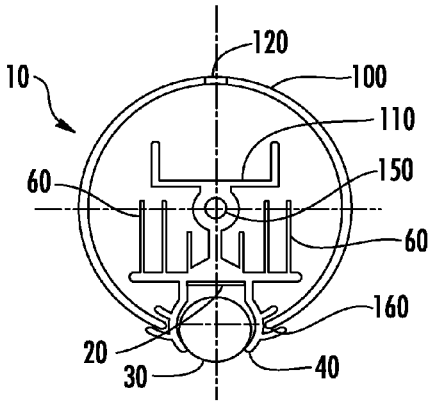
FIG. 4 illustrates a cross sectional view of a further embodiment of a lighting device in accordance with teachings of the present disclosure, the device including an attached housing.

FIG. 4 illustrates a cross sectional view of a further embodiment of a lighting device 10. The illustrated device 10 includes, inter alia, a separately provided attached housing 100. The support structure 40 may include a means for receiving or connecting to a separate housing 100. For example, as generally illustrated, the support structure 40 may comprise a receiving portion 160 that is configured to attach or connect with portions of a housing 100. For some embodiments, the support structure 40 may comprise a separately extruded component and the outer housing 100 may essentially be or conform to a standard stock configuration.

In addition to the depiction of a form of optional attachment or connection opening 120, FIG. 4 also depicts an alternate configuration of protrusions or fins 60. However, it is noted that various alternative configurations of the illustrated elements are also contemplated by the present disclosure, and the disclosure should not be construed as being limited to the specific configurations that are illustrated.

Figure 5:
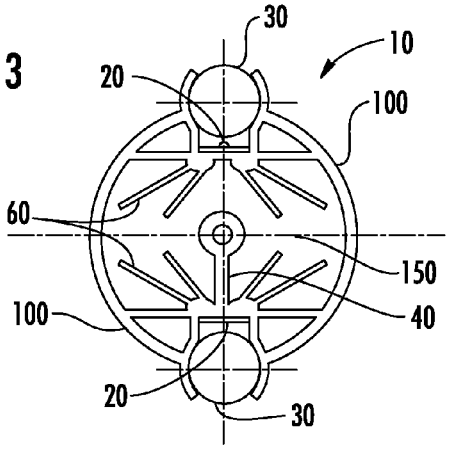
FIG. 5 illustrates a cross sectional view of still a further embodiment of a lighting device in accordance with teachings of the present disclosure, the device having a double-ended design.

FIG. 5 generally illustrates a cross sectional view of still a further embodiment of a lighting device 10 in accordance with teachings of the present disclosure. In the illustrated embodiment, the device 10 includes two optical elements 30 that are provided in a double-ended or back-to-back configuration. Such a configuration can permit light to be directed in multiple directions. The device can be configured to emit light, in this instance, up and down simultaneously, or separately in either direction, as controllably desired. The disclosure is of course not limited to the depicted configuration and the device may instead be structured to provide the illustrated optical elements at different relative angular positions and/or to include additional optical elements to provide for further directional lighting options.

Figure 6:
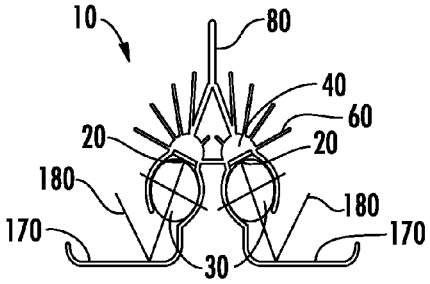
FIG. 6 illustrates yet a further embodiment of a lighting device in accordance with teachings of the present disclosure, the device including multiple reflective surfaces to provide indirect lighting.

FIG. 6 illustrates yet a further embodiment of a lighting device in accordance with teachings of the present disclosure. As generally illustrated the device 10, shown without a housing (which is optional), may include a plurality of optical elements 30 and a plurality of reflective surfaces 170 that can be configured to provide indirect lighting. As with other embodiments, the power source (not shown), may be provided remotely and can simply be connected (via wiring) to associated LEDs. In an embodiment, such as that shown in FIG. 6, one or more reflective surfaces 170 may be formed integrally with the support structure 40. To facilitate reflection—such as illustrated by beam 180—the reflective surfaces 170 may be painted (e.g., white or silver); the reflective surfaces may be comprised of a material that provides a sufficient/high degree of reflection (e.g., an aluminized surface, such as a diffused anodized silver surface); or may simply be plated with a material providing sufficient degree of reflection.

Figure 7:
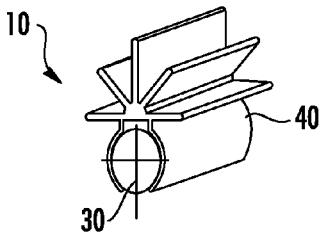
FIG. 7 illustrates an isometric view of an embodiment of a device in accordance with teachings of the present disclosure.
Figure 8:
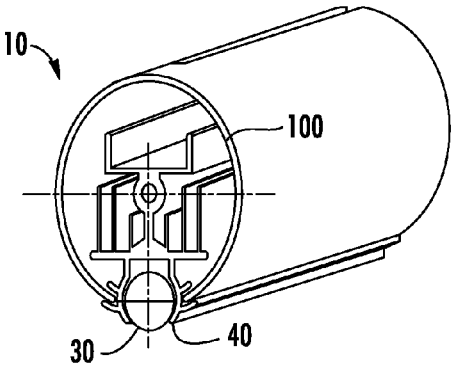
FIG. 8 illustrates an isometric view of an embodiment of a device in accordance with teachings of the present disclosure, the device including a housing.
Figure 9:
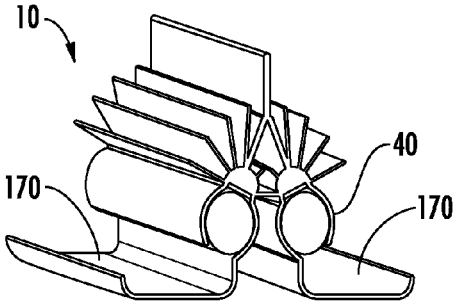
FIG. 9 illustrates an isometric view of an embodiment of a device in accordance with teachings of the present disclosure, the device including multiple optical elements and multiple reflective surfaces.

Turning to subsequent figures, additional isometric embodiments are shown. FIG. 7 generally illustrates an isometric view of an embodiment of a device 10 including an optical element 30 and support structure 40. FIG. 8 generally illustrates an isometric view of a device that is similar to the embodiment shown in FIG. 4 and includes a housing 100. FIG. 9 illustrates an isometric view of an embodiment of a device 10 that includes multiple optical elements 30 and multiple reflective surfaces 170.

Figure 10:
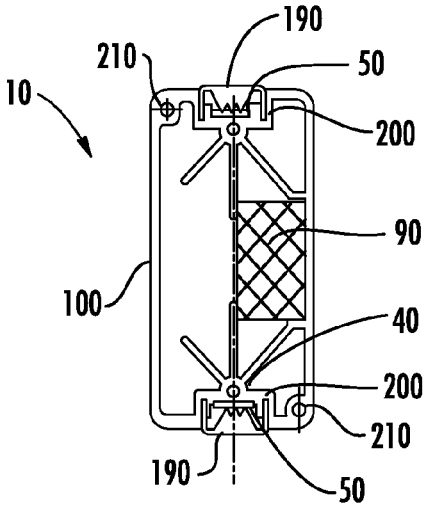
FIG. 10 illustrates a cross sectional view of an embodiment of a device in accordance with teachings of the present disclosure, the device including sealed optical lenses.

FIG. 10 illustrates a cross sectional view of an embodiment of a device 10 that includes one or more optical lenses 190—shown in the figure in a dual-end configuration. The illustrated device 10 additionally includes a plurality of LED strips 50, a power supply 90, and a housing 100. In embodiments, one or more optical lenses may be sealed and/or may be configured to modify the emitted light. Such lenses 190 may, without limitation, be comprised of an extruded acrylic and may, if desired, be secured, at least in part, by an adhesive. It is noted that the invention is not limited to the configurations of lenses disclosed herein and other lens configurations are anticipated. It is readily understood that others lens types, that if desired may be molded or extruded, may provide various beam patterns. For instance, a round optical element may provide relatively little lateral control of beam spread. In embodiments, the inclusion of a molded lens with refractive optics may limit the spread of light, which may be desirable for some task lighting situations. Further, if desired, a lens 190 may be configured to provide various optical characteristics, e.g., total internal reflection (TIR), and may if desired serve to straighten light beams out prior to externally dispersion. Housing 100 may be configured to include one or more recesses or channels 200 that may be configured to receive and/or secure a portion of an optical lens 190. As generally illustrated, device 10 may also include one or more mounting features 210 (such as a threaded or unthreaded aperture or other receiving means) that may be used to secure an end cap or end plate (not shown).

Figure 11:
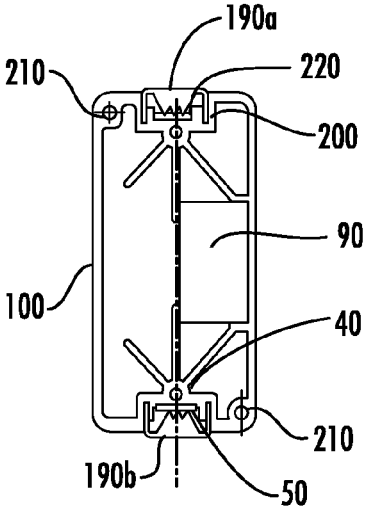
FIG. 11 illustrates a cross sectional view of another embodiment of a device in accordance with teachings of the present disclosure, the device including multiple lenses.

FIG. 11 illustrates a cross sectional view of another embodiment of a device 10 that includes multiple optical lenses 190. As generally illustrated, one or more optical lens 190*a* may be received and retained within a receiving formation 220 that is connected to or formed integrally with the support structure and/or housing. For example, some extruded support structures and/or housings may include a channel into which a lens may be inserted and, depending upon the configuration, additional fasteners may not be needed to retain the lens.

Figure 12:
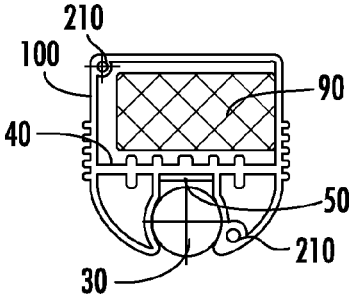
FIG. 12 illustrates a cross sectional view of an embodiment of a device, the device including a power supply and mounting features.
Figure 13:
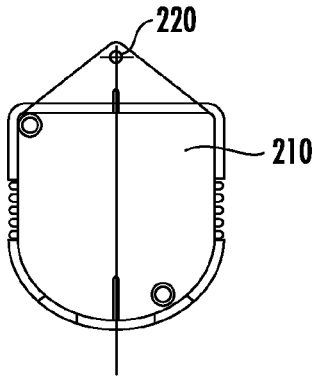
FIG. 13 illustrates a side view of an embodiment of a cover of the type that may be associated with the device shown in FIG. 11.

FIG. 12 generally illustrates a cross sectional view of a device 10. The illustrated embodiment is shown including a power supply 90 and a plurality of mounting features 210. It is noted that device 10 could, if desired, include an optical lens that extends over the optical element 30 to seal the optical element and/or modify the dispersion of light. FIG. 13 illustrates an embodiment of an end plate or cover 210 that may be connected to a device of the type shown in FIG. 12. In the illustrated embodiment, end plate or cover 210 includes a formation that may, if desired, be used to support or mount the device. In embodiments, optical elements are retained in channels formed in an extruded support structure and end covers are secured at each end of the support structure. Moreover, if desired, features for screw retention can be provided in the extruded support structure.

Figure 14:
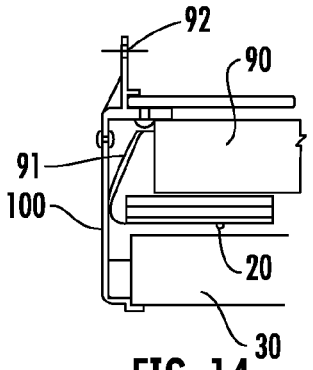
FIG. 14 illustrates a cross sectional view of an embodiment of a device, the device depicting an LED circuit board, an LED, a power supply, connective wiring, and an attachment feature.
Figure 15:
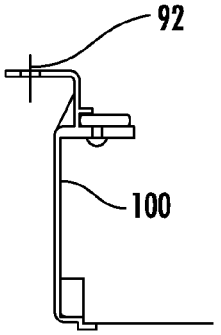
FIG. 15 illustrates a cross sectional view of an alternative embodiment of an attachment feature.

FIGS. 14 and 15 are cross sectional views of embodiments of a device that depict an LED circuit board 50, an LED 20, a power supply 90, connective wiring 91, and attachment features 92. The figures generally illustrate, without limitation, a configuration for providing power to and within the various components of a device.

It is understood that the invention is not limited to the specific disclosed embodiments. Some variations may, without limitation, provide the following:

- different diameter optical elements (e.g., rods)
- different shaped optical elements
- additional optical features on or in connection with the optical elements, such as lenses—which may provide further light control or effect
- differing LEDs for both light output, color, and angular beam spread
- different colored LEDs for decorative or accent lighting either in the main or supplemental emitter
- additional emitters in conjunction with a primary emitter
- additional light emitters projecting in different directions
- additional light optical elements projecting in either white, colored, or multi-colored light based on the LEDs used
- variations associated with the housing construction, such as: being extruded in conjunction with the other light emitting components of the device, utilizing a separate extruded or formed tube made from any material that can be suitably formed and utilized, and finishing the housing with a commercially available coating process
- when a preformed housing is used, a slot created axially along the length of the housing that will then slide into a pair of opposed slots in an extruded section
- the housing can provide various decorative and/or protective elements to the device or assembly.

The foregoing descriptions of specific embodiments of the present invention have been presented for purposes of illustration and description. They are not intended to be exhaustive or to limit the invention to the precise forms disclosed, and various modifications and variations are possible in light of the above teachings. The embodiments were chosen and described in order to explain the principles of the invention and its practical application, to thereby enable others skilled in the art to utilize the invention and various embodiments with various modifications as are suited to the particular use contemplated.

What is claimed is:

1. An LED lighting device comprising:

a plurality of light emitting diodes (LEDs) mounted on at least one substrate;

at least one optical element, said optical element being rod-shaped and a total internal reflection (TIR) lens;

a support structure formed from a thermally conductive material, said support structure having:

at least one channel for receiving and retaining the substrate;

at least one fin adapted for dissipating heat produced by the plurality of light emitting diodes; and a pair of opposing support segments for retaining the optical element in relation to the plurality of light emitting diodes.

2. The LED lighting device of claim 1 wherein the each optical element is in sealing engagement with the pair of opposing support segments and thereby seals the at least one channel in the support member.

3. An LED lighting device comprising:

a plurality of substrates, each having a plurality of light emitting diodes (LEDs) mounted thereon;

a plurality of optical elements, each of said optical elements being rod-shaped;

a support structure formed from a thermally conductive material, said support structure having:

a plurality of channels for receiving said plurality of substrates upon which LED's are mounted;

at least one fin adapted for dissipating heat produced by the plurality of light emitting diodes; and a plurality of retaining members, each including a pair of opposing support segments for retaining one of said plurality of optical elements; and wherein said plurality of optical elements, said plurality of channels and said plurality of retaining members are arranged to allow light to be emitted from the LED's in a plurality of directions.

4. The LED lighting device of claim 3 wherein the device further comprises a supplemental emitter.

5. The LED lighting device of claim 3 further comprising a support tray for a power supply wherein the support tray for the power supply is formed integrally with the support structure.

6. An LED lighting device comprising:

a plurality of light emitting diodes (LEDs) mounted on at least one substrate;

at least one optical element, said optical element being a total internal reflection (TIR) lens;

a power supply;

a support structure formed from a thermally conductive material, said support structure having:

at least one channel for receiving and retaining the substrate;

at least one fin adapted for dissipating heat produced by the plurality of light emitting diodes; and at least one retaining member for retaining the at least one optical element in relation to the plurality of light emitting diodes; and a housing adapted for attachment to the support structure.

7. The LED lighting device of claim 6 wherein the optical element is selected from the group consisting of: a clear round rod, a translucent round rod, and a colored round rod.

8. The LED lighting device of claim 6 wherein the support structure further comprises at least one reflective surface.

9. The LED lighting device of claim 8 wherein the at least one reflective surface is positioned after said optical element such that light contacts the reflective surface after passing through said optical element.

10. The LED lighting device of claim 6 further comprising a support tray for a power supply wherein the support tray for the power supply is formed integrally with the support structure.

11. The LED lighting device of claim 6, wherein optical element is positioned within about 0.01-0.02 inches of the plurality of light emitting diodes.

* * * * *